US012339103B2

(12) United States Patent
Kasendra et al.

(10) Patent No.: US 12,339,103 B2
(45) Date of Patent: Jun. 24, 2025

(54) MULTILAYER BALLISTIC BARRIER AND A METHOD OF MAKING THE MULTILAYER BALLISTIC BARRIER

(71) Applicants: Tomasz Kasendra, Cracow (PL); Krzysztof Kasendra, Cracow (PL); Jerzy Kuśmierczyk, Bielsko-Biala (PL); Jacek Pietrzak, Lubliniec (PL)

(72) Inventors: Tomasz Kasendra, Cracow (PL); Krzysztof Kasendra, Cracow (PL); Jerzy Kuśmierczyk, Bielsko-Biala (PL); Jacek Pietrzak, Lubliniec (PL)

( * ) Notice: Subject to any disclaimer, the term of this patent is extended or adjusted under 35 U.S.C. 154(b) by 0 days.

(21) Appl. No.: 18/690,075

(22) PCT Filed: Sep. 7, 2022

(86) PCT No.: PCT/PL2022/050055
§ 371 (c)(1),
(2) Date: Mar. 7, 2024

(87) PCT Pub. No.: WO2023/038537
PCT Pub. Date: Mar. 16, 2023

(65) Prior Publication Data

US 2024/0401915 A1 Dec. 5, 2024

(30) Foreign Application Priority Data

Sep. 7, 2021 (PL) ..... 438893
Apr. 26, 2022 (PL) ..... 441029

(51) Int. Cl.
*F41H 5/24* (2006.01)
*F41H 5/013* (2006.01)
*F41J 13/00* (2009.01)

(52) U.S. Cl.
CPC ..... *F41H 5/24* (2013.01); *F41H 5/013* (2013.01); *F41J 13/00* (2013.01)

(58) Field of Classification Search
CPC ..... F41H 13/00; F41H 5/013; F41H 5/24
See application file for complete search history.

(56) References Cited

U.S. PATENT DOCUMENTS 2,610,503 A * 9/1952 Hall ..... E04B 2/42 D25/118
4,049,864 A * 9/1977 Hoover ..... F41H 5/0414 109/82

(Continued)

FOREIGN PATENT DOCUMENTS

GB 2242730 A 10/1991
KR 10-2011-0029759 A 3/2011

OTHER PUBLICATIONS

International Search Report and Written Opinion for PCT International Patent Application No. PCT/PL2022/050055, mailed Feb. 6, 2023.

*Primary Examiner* — Joshua E Freeman
(74) *Attorney, Agent, or Firm* — LATHROP GPM LLP; James H. Velema, Esq.

(57) ABSTRACT

A multilayer ballistic barrier comprising at least one barrier plate (1) having a thickness of up to 250 mm, made of an elastomeric material containing butadiene and a binder, and a fill (2) having a minimum thickness of 50 mm in the form of mineral aggregates of various fractions ranging from 0.5 to 80 mm. The application also relates to a method of making the multilayer ballistic barrier and its use for the construction of bullet-proof walls and floors intercepting projectiles with a kinetic energy up to 50 000 J.

17 Claims, 5 Drawing Sheets

(56) References Cited

U.S. PATENT DOCUMENTS 4,895,063 A * 1/1990 Marlow ..... F41H 5/0457 89/36.02
5,114,270 A * 5/1992 Riddle ..... E02B 3/06 405/32
5,690,322 A * 11/1997 Hay ..... F16F 7/14 267/273
9,891,029 B2 * 2/2018 Oh ..... F41J 13/00
11,572,691 B1 * 2/2023 Newton ..... E04C 2/46
2008/0006146 A1 * 1/2008 Magnusson ..... F41H 5/0492 89/36.02
2008/0155929 A1 * 7/2008 Herron ..... E04H 9/04 52/582.1
2009/0020241 A1 * 1/2009 Bowlware ..... E04H 9/10 160/351
2009/0090236 A1 * 4/2009 Misencik ..... E04H 9/10 89/36.02
2009/0235507 A1 * 9/2009 Cashin ..... F42D 5/045 29/402.08
2010/0282060 A1 * 11/2010 Duke ..... E04B 2/08 89/917
2011/0197746 A1 * 8/2011 Melrose ..... E04H 9/10 89/937
2012/0174756 A1 * 7/2012 Wilson ..... F41H 5/04 89/36.02
2012/0247311 A1 * 10/2012 Warner ..... E04H 15/20 89/36.01
2013/0092017 A1 * 4/2013 Bridewell ..... F41H 7/04 248/560
2013/0295805 A1 * 11/2013 de Haas ..... F41H 5/0485 442/1
2014/0305061 A1 * 10/2014 Phillips ..... E04B 2/62 52/437
2015/0266615 A1 * 9/2015 Kriegstein ..... E04H 9/145 405/16
2016/0377388 A1 * 12/2016 Van Ommering ..... F41H 5/24 89/36.02
2017/0175388 A1 * 6/2017 Siver ..... F41H 5/0414
2018/0112955 A1 * 4/2018 Malone ..... F41H 5/12
2020/0284553 A1 * 9/2020 Esquilin-Mangual .... E04H 9/04
2021/0396495 A1 * 12/2021 Ciparro ..... F41H 5/0428
2022/0146234 A1 * 5/2022 Van Heerden ..... C08J 5/246
2022/0276029 A1 * 9/2022 Kasendra ..... F41J 13/00

* cited by examiner

MULTILAYER BALLISTIC BARRIER AND A METHOD OF MAKING THE MULTILAYER BALLISTIC BARRIER

RELATED APPLICATIONS

The instant application is a 35 U.S.C. § 371 filing of International Patent Application No. PCT/PL2022/050055, filed Sep. 7, 2022, which claims priority to Poland Patent Application Nos. P.441029, filed Apr. 26, 2022, and P.438893, filed Sep. 7, 2021, the entire contents of which are incorporated herein by reference for all purposes.

The object of the invention is a multilayer ballistic barrier that absorbs projectiles fired towards it, irrespective of their trajectory from various types of ammunition with a projectile kinetic energy of up to 50 000 J, and a method of making the multilayer ballistic barrier.

Nowadays, ballistic walls (either uniform or constructed with ballistic plates or blocks) are made of composite materials, polymers or suitable gels.

From publication WO13087370 A2, a ballistic block is known which is used for the construction of a ballistic wall and comprises a body made of a composite material and spatial parts placed in the body, made of a composite material containing at least one type of fibre and at least one type of resin. The spatial elements include channels located along the body, arranged to modify the trajectory of the ballistic projectile pieces and eliminate the pressure exerted on the blocks that form the wall.

From publication GB2242730 A, on the other hand, a container is known which is at least partly made of a material having self-bonding properties, such as a thermoplastic or flexible material, is filled with rubber pellets, and serves to stop small projectiles and to trap within it all projectiles that hit the container, as well as their fragments and lead particles. This container allows for easy removal of fired projectiles and lead particles and is also portable. Many such containers can be assembled to form a wall.

Whereas publication CA3032373 A1 shows a transparent bullet-proof coating consisting of a ballistic block made up of at least two transparent sheets tightly adhered to at least one adhesive layer, each sheet being at least 3 mm thick, and of a fireproof unit made up of at least two sheets and with a space between the fireproof unit and the ballistic block.

Anti-ricochet plates are also known which are used on the floor of shooting ranges and the task of which is to intercept projectiles fired only at an acute angle (10-15 degrees), but in the case of angles in the range of 25-90 degrees, these plates do not have ballistic properties and a projectile fired in their direction may uncontrollably return to the shooter, bouncing off steel plates or concrete underneath such plates.

The aim of the invention is to develop a new multi-layer ballistic barrier used as a (both vertical and horizontal) bullet-proof protection, comprising a barrier plate made of an elastomeric material or an elastomeric-polyurethane mixture with aggregate to be used for the construction of bullet-proof walls and floors that intercept projectiles, and a method of making this ballistic barrier.

The essence of the solution according to the invention is that the multilayer ballistic barrier comprises a barrier plate with a thickness of up to 250 mm and is made of an elastomeric material containing butadiene and a binder, while the fill has a minimum thickness of 50 mm and is constituted by a mixture of mineral aggregates of various fractions ranging from 0.5 to 80 mm.

Preferably, the binder can be ethylene copolymer or vinyl acetate, or a polymeric binder containing polyols or isocyanates.

Preferably, the aggregate is provided with a copolymer coating.

Preferably, the multilayer ballistic barrier is provided with side walls shaped to fit against each other.

Preferably, the multilayered ballistic barrier is provided with bulkheads.

Preferably, the barrier plate is connected to another barrier plate or wall by means of connectors.

Preferably, the connectors are made of elastomeric material, steel, wood, polymer or composite.

Preferably, the connectors are in the shape of straight, broken or curved profiles, pins or bars that have a polygonal, circular or irregular cross-section.

Preferably, the connectors are made of wire, cable, rope or chain.

Preferably, the multilayer ballistic barrier comprises at least one inner plate located perpendicular to the barrier plate.

Preferably, the barrier plate is monolithic, i.e. made of a single plate, or modular, i.e. made of many smaller plates.

Preferably, the multilayer barrier is provided with at least one dispersion plate adjacent to the barrier plate.

The essence of the method of making the multilayer ballistic barrier according to the invention is that 60-95% by weight of an elastomeric material containing butadiene and 5-40% by weight of a binder are placed in a mixer, followed by mixing until the binder fully encapsulates the elastomeric material, which mixture is then placed in moulds until fully bonded, and the barrier thus obtained is unmoulded and cooled, and then connected to another barrier plate or wall, and the space between the barrier plates or the barrier plate and the wall is filled with mineral aggregate of various fractions ranging from 0.5 to 80 mm.

Preferably, the moulds are heated to a temperature of 50 to 240° C. before the mixture of elastomeric material and binder is placed therein.

Preferably, the mineral aggregate is coated with a copolymer coating before filling.

The object of the invention is also the use of the multilayer ballistic barrier for the construction of bullet-proof walls or bullet-proof floors that intercept projectiles with a kinetic energy of up to 50 000 J.

The solution according to the invention is shown in embodiments and in the accompanying drawing, where:

FIG. 1*a* shows two ballistic blocks, the walls of which are modular elements of a ballistic plate (1) that are provided with flat side walls (3) and bulkheads (4);

FIG. 1*b* shows two ballistic blocks, the walls of which are modular elements of the ballistic plate (1) that are provided with corrugated side walls (3) and bulkheads (4);

FIG. 1*c* shows two ballistic blocks, the walls of which are modular elements of the ballistic plate (1) that are provided with broken side walls (3) and bulkheads (4);

FIG. 1*d* shows two ballistic blocks, the walls of which are modular elements of the ballistic plate (1) that are provided with broken side walls (3) and bulkheads (4);

FIG. 2*a* shows a ballistic barrier comprising two modular ballistic plates (1) made of the ballistic blocks shown in FIG. 1*a;*

FIG. 2*b* shows a ballistic barrier comprising two modular ballistic plates (1) made of the ballistic blocks shown in FIG. 1*b;*

FIG. 2*c* shows a ballistic barrier comprising two modular ballistic plates (1) made of the ballistic blocks shown in FIG. 1*c;*

FIG. 2*d* shows a ballistic barrier comprising two modular ballistic plates (1) made of the ballistic blocks shown in FIG. 1*d;*

FIG. 3*a* shows a ballistic barrier comprising two monolithic ballistic plates (1);

FIG. 3*b* shows a ballistic barrier comprising two monolithic ballistic plates (1) connected by means of connectors (5);

FIG. 3*c* shows a ballistic barrier comprising two monolithic ballistic plates (1) connected by means of connectors (5);

FIG. 3*d* shows a ballistic barrier comprising two monolithic ballistic plates (1) connected by means of connectors (5);

FIG. 4*a* shows a ballistic barrier placed against a wall (7), comprising one ballistic plate (1);

FIG. 4*b* shows a ballistic barrier placed against a wall (7), comprising one ballistic plate (1) provided with connectors (5);

FIG. 4*c* shows a ballistic barrier placed against a wall (7), comprising one ballistic plate (1) provided with connectors (5);

FIG. 4*d* shows a ballistic barrier placed against a wall (7), comprising one ballistic plate (1) provided with connectors (5);

The multilayer ballistic barrier and the method of making it are shown in the examples below:

Example 1: In the first embodiment and as shown in FIG. 2*a*-2*d*, the ballistic barrier is constructed from the ballistic blocks shown in FIG. 1*a*-1*d*. The ballistic barrier comprises two barrier plates 1 with a thickness of 5 mm, being also the walls of the blocks, and a fill 2. The barrier plates 1 are made of an elastomeric material containing butadiene and a polymeric binder containing polyols. The fill 2 has a thickness of 260 mm and is a mixture of mineral aggregate of various fractions ranging from 1 to 80 mm. The aggregate is provided with a copolymer coating. The wall was made by the method according to the invention, so that 85% by weight of the elastomeric material containing butadiene and 15% by weight of the binder were placed in a horizontal screw mixer a rotational speed of about 80 revolutions per minute, a screw length of 1000 mm and a diameter of 200 mm, with a mixing capacity of about 15 kg/min, followed by mixing until the binder fully encapsulated the elastomeric material. Then, the contents of the mixer were placed in moulds heated to a temperature above 50° C. and left to rest until fully bonded, the ballistic blocks thus obtained were unmoulded and cooled, connected and then filled with mineral aggregate of various fractions ranging from 1 to 80 mm.

Figure 1A:
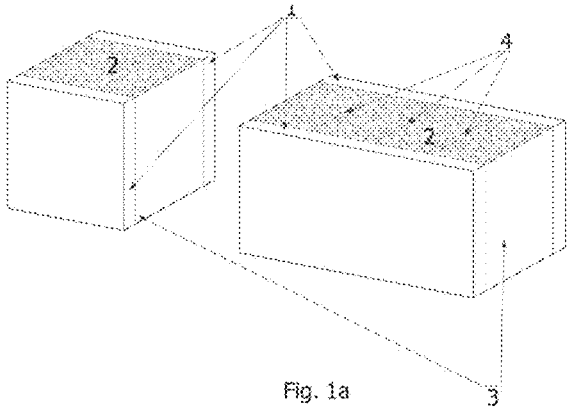
Figure 1B:
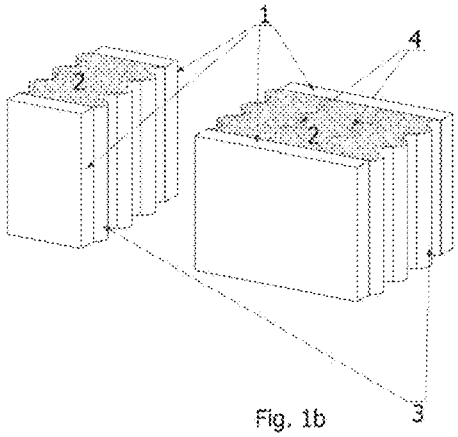
Figure 1C:
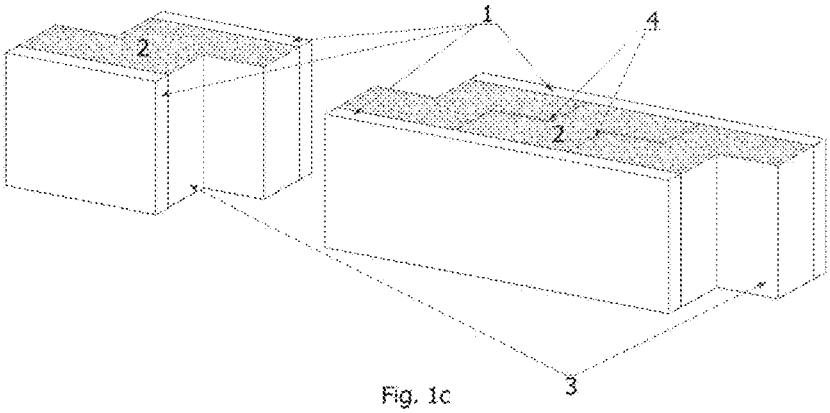
Figure 1D:
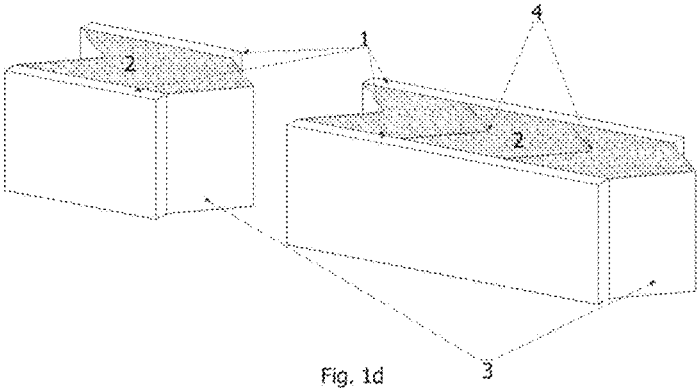
Figure 2A:
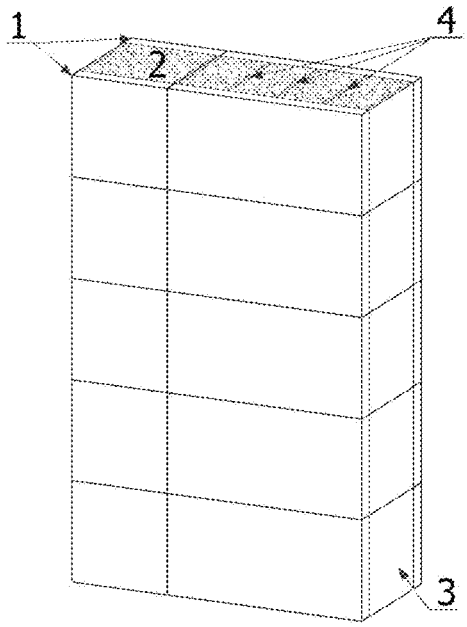
Figure 2B:
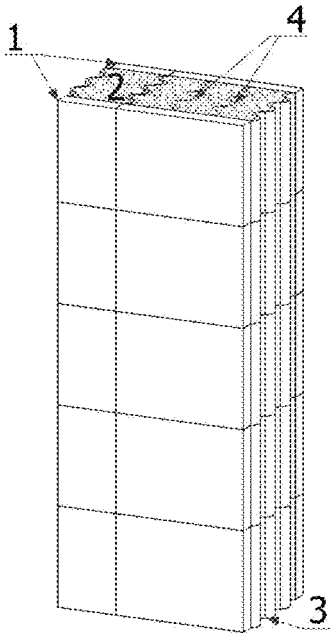
Figure 2C:
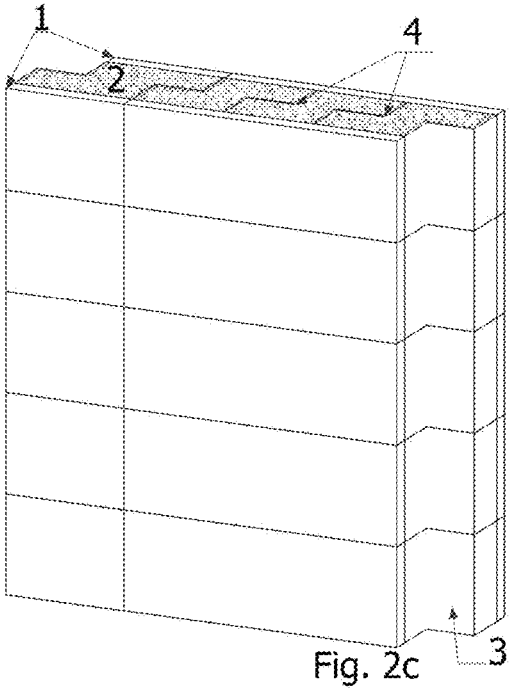
Figure 2D:
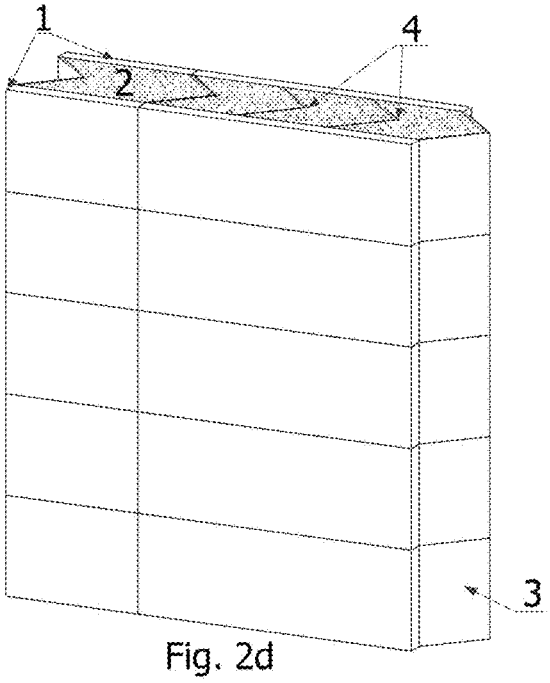
Figure 3A:
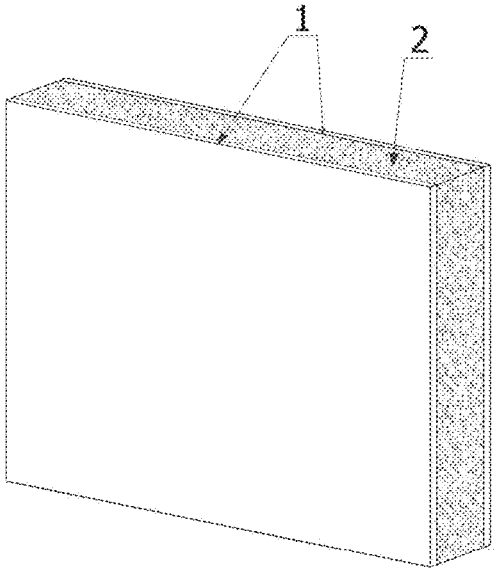
Figure 3B:
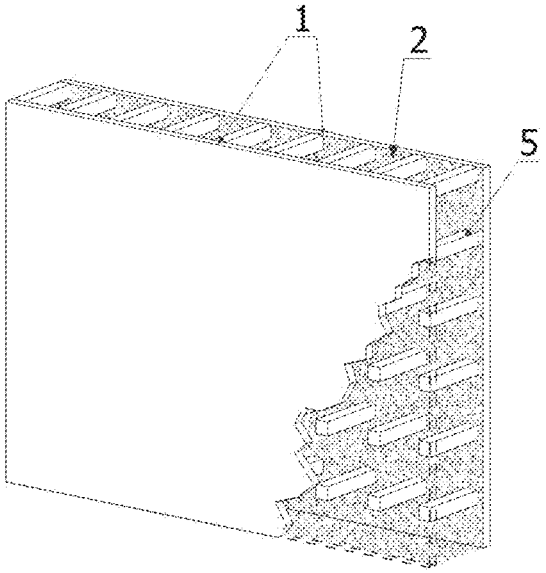
Figure 3C:
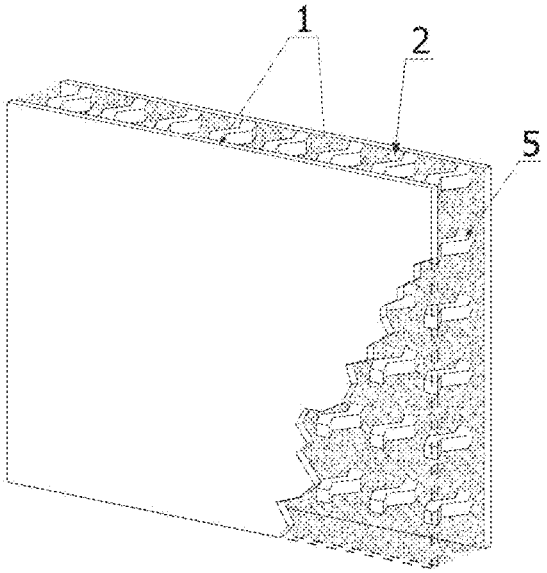
Figure 3D:
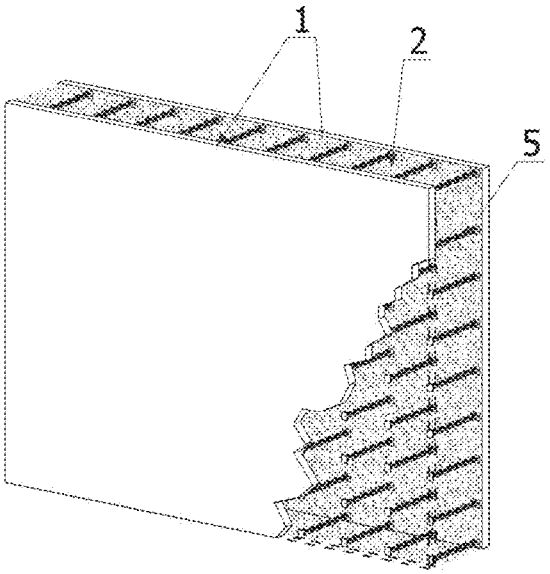
Figure 4A:
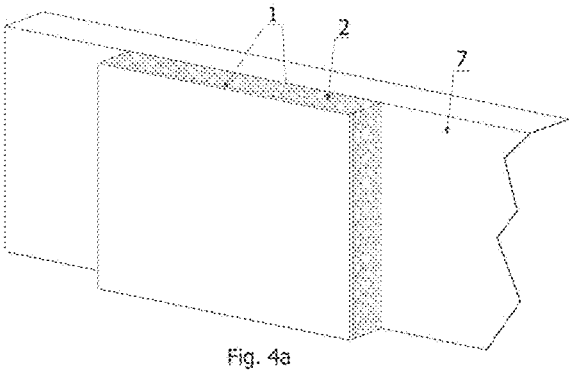
Figure 4B:
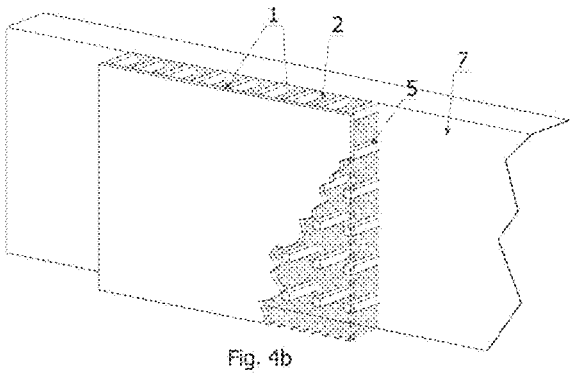
Figure 4C:
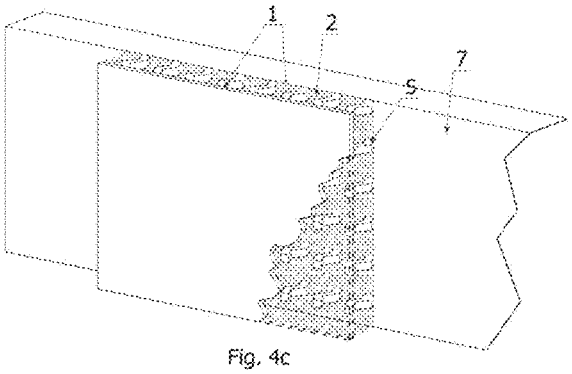
Figure 4D:
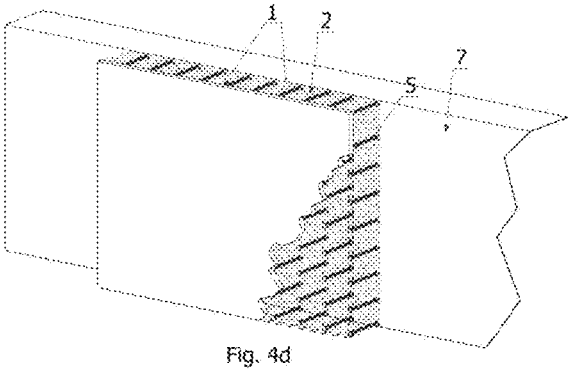

Example 2: In the second embodiment and as shown in FIG. 3*a*-3*d*, the ballistic barrier is constructed from two barrier plates 1 with a thickness of 50 mm and a fill 2. The barrier plate 1 is made of an elastomeric material containing butadiene with a granular or abrasive structure or a mixture of these two structures and a polymeric binder containing isocyanates. The fill 2 has a thickness of 300 mm and is a mixture of mineral aggregate of various fractions ranging from 0.5 to 80 mm. The ballistic barrier was made by the method according to the invention, so that 65% by weight of the elastomeric material containing butadiene and 35% by weight of the binder were placed in a vertical screw mixer a rotational speed of about 30 revolutions per minute, a screw length of 250 mm and a diameter of about 1000 mm, and with a mixing capacity of about 5 kg/min, followed by mixing until the binder fully encapsulated the elastomeric material. Then, the contents of the mixer were placed in moulds heated to a temperature of 140° C. and left to rest until fully bonded, the barrier plates 1 thus obtained were unmoulded and cooled, connected, and the space between the plates was filled with mineral aggregate of various fractions ranging from 0.5 to 80 mm. As shown in FIG. 3*b*-3*d*, the barrier plates 1 were connected by means of straight pins, bent pins or chains.

Example 3: In the third embodiment and as shown in FIG. 4*a*-4*d*, the ballistic barrier is constructed from one barrier plate 1 with a thickness of 100 mm and a fill 2. This barrier is adjacent to a retaining wall 7. The barrier plate 1 is made of an elastomeric material containing butadiene and an ethylene copolymer binder. The fill 2 has a thickness of 320 mm and is a mixture of mineral aggregate of various fractions ranging from 0.5 to 10 mm. The barrier was made by the method according to the invention, so that 65% by weight of the elastomeric material containing butadiene and 35% by weight of the binder were placed in a vertical screw mixer a rotational speed of about 30 revolutions per minute, a screw length of 250 mm and a diameter of about 1000 mm, and with a mixing capacity of about 5 kg/min, followed by mixing at a temperature of 200° C. for 3 minutes, until the binder fully encapsulated the elastomeric material. Then, the contents of the mixer were placed in moulds heated to a temperature of 200° C. and left to rest until fully bonded, the barrier plate 1 thus obtained was unmoulded and cooled, connected to the retaining wall 7, and then the space between them was filled with mineral aggregate of various fractions ranging from 0.5 to 10 mm. The mineral aggregate was coated with a copolymer coating before filling. Pins (straight or curved) and chains were used to connect the barrier plate 1 to the retaining wall 7, as shown in the attached drawing. Bonded or screwed, bolted, pinned or welded construction elements, as well as a lock and tongue-and-groove can be used for this connection.

Figure 5:
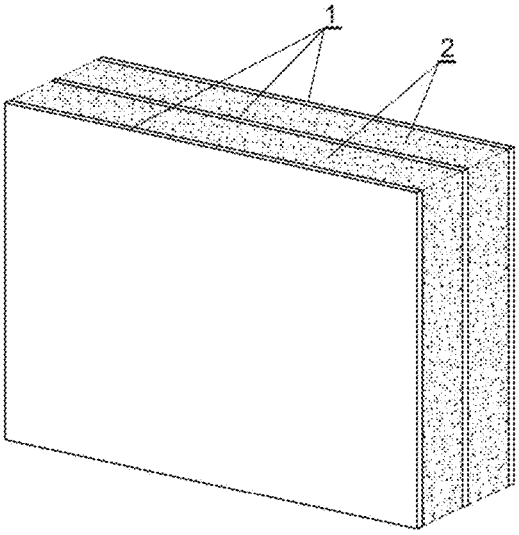
FIG. 5 shows a ballistic barrier comprising three ballistic plates (1)

Example 4: In the fourth embodiment and as shown in FIG. 5, the ballistic barrier is constructed from three barrier plates 1 with a thickness of 40 mm each and two fill layers 2. The barrier plates 1 are made of an elastomeric material containing butadiene and a vinyl acetate binder. Each fill layer 2 has a thickness of 280 mm and is a mixture of mineral aggregate of various fractions ranging from 0.5 to 80 mm. The barrier was made by the method according to the invention, so that 70% by weight of the elastomeric material containing butadiene and 30% by weight of the binder were placed in a vertical screw mixer a rotational speed of about 30 revolutions per minute, a screw length of 250 mm and a diameter of about 1000 mm, and with a mixing capacity of about 5 kg/min, followed by mixing at a temperature of 200° C. for 5 minutes, until the binder fully encapsulated the elastomeric material. Then, the contents of the mixer were placed in mould s heated to a temperature of 150° C. and left to rest until fully bonded, the barrier plates 1 thus obtained were unmoulded and cooled, connected, and the spaces between them were filled with mineral aggregate of various fractions ranging from 0.5 to 80 mm. The mineral aggregate was coated with a copolymer coating before filling.

Figure 6:
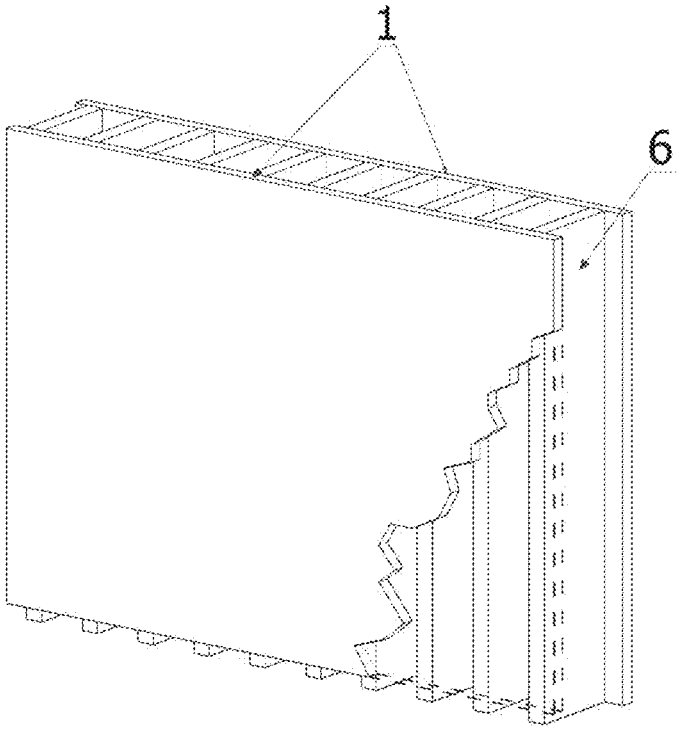
FIG. 6 shows a ballistic barrier provided with inner plates (6)

Example 5: In the fifth embodiment and as shown in FIG. 6, the ballistic barrier is provided with inner plates 6 with a thickness of 30 mm sandwiched between two barrier plates with a thickness of about 15 mm. A front barrier plate 1 with a lower compression of 1.5:1 and a Shore hardness of 40°-60° ShA allows smoother projectile entry into the ballistic barrier without projectiles bouncing, or ricocheting. The use of inner plates 6, with a significantly higher compression of 2:1 and a Shore hardness of 60°-85° ShA, allows high ballistic properties to be obtained. This solution allows shots to be fired at a minimum angle in relation to the barrier plate 1 without ricocheting. The inner plates 6 slow down and intercept projectiles that, entering through the barrier plate 1 into the interior of the multilayer ballistic barrier, fall by gravity and spontaneously into the lower part of the ballistic barrier, allowing it to be cleared quickly and easily.

Figure 7:
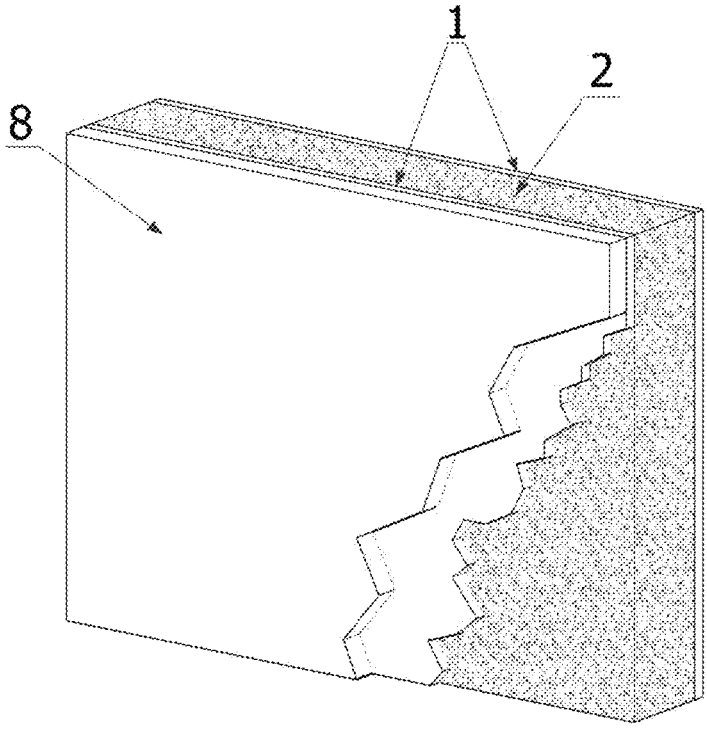
FIG. 7 shows a ballistic barrier provided with a dispersion plate (8).

Example 6: In the sixth embodiment and as shown in FIG. 7, a barrier plate 1 is covered with a dispersion plate 8. The use of the dispersion plate 8 with a thickness in the range of 3-200 mm and a low density, Shore hardness of 30°-65° ShA, has a positive effect on reducing the input kinetic energy of the projectile and reducing the velocity of the projectile before it enters into the barrier plate. Thereby, the dispersion plate reduces the wear and tear of the barrier plates 1 and at the same time absorbs part of the shock wave coming from the projectile, positively affecting the durability of the ballistic barrier. The number of the dispersion plates 8 mounted before the barrier plate 1 allows the velocity and energy of the projectiles to be controlled according to the desired calibre of firearm. The dispersion plate 8 should assume the shape of a flat plate or a flat plate with tabs that further positively influence the dispersion of the shock wave.

The ballistic barrier according to the invention is made of at least two layers—at least one barrier plate 1 made of an elastomeric material and a fill 2 in the form of mineral aggregate. It is possible to use each layer individually as well as repeatedly, e.g. elastomer-aggregate-elastomer or elastomer-aggregate-elastomer-aggregate-elastomer. The ballistic barrier according to the invention can be monolithic (made of a single element) as well as modular (made of aggregate-filled plates or blocks). The barrier according to the invention can also be made in the form of modules provided with side walls 3 or bulkheads 4 made preferably of elastomeric, steel, wood, composite as well as polymeric materials. Thanks to the shapes of the side walls 3 and bulkheads 4 allowing them to fit together, it is possible to freely cut the multilayer ballistic barrier and to tightly connect the ballistic barriers without losing the ballistic properties of the structure.

The barrier plate is made of an elastomeric material that contains butadiene. The thickness of the barrier plate ranges up to 250 mm. The hardness of the elastomer used for the barrier plate is between 40 and 85 ShA (Shore scale).

In order to obtain the barrier plate, the elastomeric material is mixed with a binder that can be both a polymeric binder containing polyols and/or isocyanates, as well as an ethylene or vinyl acetate (EVA) copolymer and other polyolefins. The blending of granulate with polymeric binders takes place at various temperatures, depending on their type, from 50 to 180° C. In the case of blending granules with EVA at temperatures between 6° and 220° C. The polymeric binder should be blended with granulate in proportions of 15-35%. EVA binder can be used in the range of 10-30%. The manufacturing process starts with the adhesion of the elastomeric material with the binder. This is done in a mixer, after which the material is lined, extruded or injected into moulds that are preferably heated to a temperature ranging from 50 to 240° C. before the process. Depending on the consistency and the mixture, the bonding process takes between 3 and 30 minutes, which depends mainly on the additives catalysing or inhibiting the process. For this reason, the bonding process can take place using energy from electrical heating, e.g. by heating with electric heaters, or through the use of energy carriers such as oil, as well as through energy supplied in water in various states of matter. Once the coating is bonded, it is unmoulded and cooled, and then is connected to another barrier plate 1 or the retaining wall 7.

Connectors 5 of various geometric shapes and structures, made of structural materials including elastomeric, wood, steel or composite materials, are used to assemble the multilayer ballistic barrier. With the use of the connectors 5, it is possible to match the thickness and shape of the multilayer ballistic barrier to the types of ammunition used. The resulting internal spaces are filled with a fill 2.

The fill 2 of the ballistic barrier according to the invention consists of mixtures of mineral aggregates of various fractions ranging from 0.5 to 80 mm. The thickness of the mineral aggregate fill 2 should not be smaller than the thickness of the ballistic barrier plate 1, as this is dependent on the needs and the energy that will be exerted on the ballistic barrier. The hardness of the aggregate should be higher than 5 on the Mohs scale. This hardness ensures that projectiles are decelerated in an appropriate manner. Depending on the aggregate fraction used, as well as its hardness, this layer causes stopping and partial or complete fragmentation of the projectile. It was observed that the higher the Mohs hardness of the aggregate used, the more it disintegrates the projectiles. The aggregate layer is preferably additionally coated with protective coatings capable of performing a variety of functions. For example, the coating can ensure the hydrophobicity of the aggregate and thus, in winter or rainy periods, prevents the phenomenon of aggregate clumping, which could have a negative impact on the performance of the fill, i.e. the closure (backfilling) of momentary channels created by a passing projectile. Another function of the coating is to protect the aggregate from algal growth or from pests. Coating the aggregate also increases the resistance to the high temperatures that occur when the projectiles penetrate the aggregate, during which time there is friction, pressure and temperature build-up, and the aggregate grains move from one to another, after which the place of the projectile's passage is backfilled with aggregate falling from above. The properly selected coating reduces friction during this process. In addition, the use of the proper coating has a protective function against dust naturally occurring in the stone, which is formed during friction. Thus, the stone is much safer to use and more comfortable to work with. In addition, the coatings impart colour to the aggregate grains, which means that any type of dust including lead from projectiles remains visible on their surface.

The solution according to the invention consists in combining an elastomeric plate structure having certain parameters and a layer of natural aggregate of an appropriate fraction, which gives unprecedented ballistic properties. The elastomeric structure performs the task of holding and restraining the aggregate layer, which makes the overall structure aesthetically pleasing and very practical to use. The elastomer has a self-bonding property and thus, after firing, the projectile passes through the barrier plate 1, and the surface area of the entry (passage) hole after the projectile has passed through decreases, depending on the calibre and velocity of the projectile, by 200 to about 1000 times. In addition, the elastomeric layer causes the projectile to slow down. The mineral aggregate behind the barrier plate 1, on the other hand, has the task of decelerating and fragmenting the projectiles as much as possible or bring them to a complete halt in their entirety. In addition, once the projectile has passed through, the formed channel (momentary channel) is backfilled by the aggregate pushing in by gravity from above, allowing multiple shots to be fired at the same point as the momentary channel is backfilled by the aggregate in a few milliseconds, thus preventing projectiles from passing further into the ballistic barrier. This is a so-far unprecedented feature as the solutions available on the market (usually based on various types of composites, polymers, gels) allow one-shot firing at a single point, as the passage (momentary) channel is not closed completely or fast enough for the next hitting projectile to also be stopped and thus for the projectiles not to penetrate the barrier. In other solutions, the momentary channel remains empty permanently creating a huge threat to the safety of shooting range users. In ballistic barrier solutions based on elastomers that have a thickness of about 30 cm, it is possible to take about 5-7 shots at a point. The solution according to the invention allows one barrier plate 1 to be shot more than 100-150 times, after which it is cleared of projectiles and can then continue to be used. In addition, an important feature of the use of elastomers for the construction of the ballistic wall is the elimination of the phenomenon of projectile ricocheting. In the solution according to the invention, the projectiles, after passing the barrier plate 1, are intercepted through a second layer made of aggregate and are destroyed (they disintegrate into smaller pieces as a result of contact with the aggregate). The problem of ricocheting is a common problem in the shooting industry and is very dangerous to the health and life of people using the shooting range. In existing solutions which use armour plates for additional protection projectiles ricochet relatively frequently. In addition, the solution according to the invention also reduces the existing phenomenon of lead dusting at the shooting ranges. In this case, the lead is retained inside by the aggregate fill 2 located behind the barrier plate 1 thereby completely reducing or minimising its harmful emission to the environment. The structure of the ballistic barrier according to the invention allows it to be used universally, including the possibility of placing it in areas with limited space, both vertically (as a wall or against a wall) and horizontally (as a floor or on a floor). Through the use of the connectors 5, the side walls 3 or the bulkheads 4, a given ballistic structure can be divided into sectors forming separate internal chambers, thereby improving the process of separation of projectile residues with aggregate and facilitating the replacement of individual wall and floor components. This type of structure can serve both as a training wall as well as, e.g., a protection wall for a room or building entrance, or a training module for horizontal firing at floors.

The possibility of using various materials for the construction of the connectors 5, the side walls 3 and the bulkheads 4 allows the ballistic barrier to be optimised for the appropriate calibre of ammunition. Thus, the side walls 3 and the bulkheads 4, the material they are made of and their shape allow the protection to be adapted accordingly and the most complex ballistic protection structures to be built with a small amount of resources, including people and time.

Through the use of specialised materials and structural elements for the construction of the barrier according to the invention, it is possible to control the fragmentation of projectiles and to capture all the hazardous volatile compounds resulting from the deceleration of all types of projectiles. Thanks to these properties, the multilayer ballistic barrier according to the invention can be used in all specialised bullet-proof structures, including the construction of floors, stairs, walls, ceilings, vertical, horizontal as well as angled bullet traps.

The invention claimed is:

1. A multilayer ballistic barrier comprising at least one barrier plate (1) and a fill (2), characterised in that the barrier plate (1) has a thickness of up to 250 mm and is made of an elastomeric material containing butadiene and a binder, while the fill (2) has a minimum thickness of 50 mm and is constituted by a mixture of mineral aggregates of various fractions ranging from 0.5 to 80 mm.

2. The multilayer ballistic barrier according to claim 1, characterised in that preferably, the binder can be ethylene copolymer or vinyl acetate, or a polymeric binder containing polyols or isocyanates.

3. The multilayer ballistic barrier according to claim 1, characterised in that the aggregate is provided with a copolymer coating.

4. The multilayer ballistic barrier according to claim 1, characterised in that it is provided with side walls (3) shaped to fit against each other.

5. The multilayer ballistic barrier according to claim 1, characterised in that it is provided with bulkheads (4).

6. The multilayer ballistic barrier according to claim 1, characterised in that the barrier plate (1) is connected to another barrier plate (1) or wall (7) by means of connectors (5).

7. The multilayer ballistic barrier according to claim 6, characterised in that the connectors (5) are preferably made of elastomeric material, steel, wood, polymer or composite.

8. The multilayer ballistic barrier according to claim 6, characterised in that the connectors (5) are in the shape of straight, broken or curved profiles, pins or bars that have a polygonal, circular or irregular cross-section.

9. The multilayer ballistic barrier according to claim 6, characterised in that the connectors (5) are made of wire, cable, rope or chain.

10. The multilayer ballistic barrier according to claim 1, characterised in that it comprises at least one inner plate (6) located perpendicular to the barrier plate (1).

11. The multilayer ballistic barrier according to claim 1, characterised in that the barrier plate (1) is monolithic or modular.

12. The multilayer ballistic barrier according to claim 1, characterised in that it is provided with at least one dispersion plate (8) adjacent to the barrier plate (1).

13. A method of making the multilayer ballistic barrier according to claim 1, characterised in that 60-95% by weight of an elastomeric material containing butadiene and 5-40% by weight of a binder are placed in a mixer, followed by mixing until the binder fully encapsulates the elastomeric material, which mixture is then placed in moulds until fully bonded, and the barrier thus obtained is unmoulded and cooled, and then connected to another barrier plate (1) or wall (7), and the space between the barrier plates (1) or the barrier plate (1) and the wall (7) is filled with mineral aggregate of various fractions ranging from 0.5 to 80 mm.

14. The method of making the multilayer ballistic barrier according to claim 13, characterised in that the moulds are heated to a temperature of 50 to 240° C. before the mixture of elastomeric material and binder is placed therein.

15. The method of making the multilayer ballistic barrier according to claim 13, characterised in that the mineral aggregate is coated with a copolymer coating before filling.

16. The use of the multilayer ballistic barrier according to claim 1 for the construction of bullet-proof walls intercepting projectiles with a kinetic energy of up to 50 000 J.

17. The use of the multilayer ballistic barrier according to claim 1 for the construction of bullet-proof floors intercepting projectiles with a kinetic energy of up to 50 000 J.

* * * * *